US009370810B2

(12) United States Patent
Kawagoe et al.

(10) Patent No.: US 9,370,810 B2
(45) Date of Patent: Jun. 21, 2016

(54) STAINLESS STEEL PLATE

(75) Inventors: Takafumi Kawagoe, Yamaguchi (JP); Tomoharu Shigetomi, Yamaguchi (JP); Junichi Katsuki, Yamaguchi (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 14/008,830

(22) PCT Filed: Mar. 30, 2012

(86) PCT No.: PCT/JP2012/058705

§ 371 (c)(1),
(2), (4) Date: Sep. 30, 2013

(87) PCT Pub. No.: WO2012/133837

PCT Pub. Date: Oct. 4, 2012

(65) Prior Publication Data

US 2014/0017517 A1 Jan. 16, 2014

(30) Foreign Application Priority Data

Mar. 31, 2011 (JP) ..... 2011-078323
Mar. 31, 2011 (JP) ..... 2011-078324

(51) Int. Cl.

| | |
|---|---|
| ***B21B 3/02*** | (2006.01) |
| ***B21B 1/22*** | (2006.01) |
| ***C22C 38/58*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/40*** | (2006.01) |
| ***C22C 38/42*** | (2006.01) |
| ***C22C 38/44*** | (2006.01) |
| ***C22C 38/48*** | (2006.01) |
| ***C21D 9/46*** | (2006.01) |

(52) U.S. Cl.

CPC . *B21B 3/02* (2013.01); *B21B 1/227* (2013.01); *C21D 6/002* (2013.01); *C21D 8/0236* (2013.01); *C21D 8/0273* (2013.01); *C21D 9/46* (2013.01); *C22C 38/02* (2013.01); *C22C 38/04* (2013.01); *C22C 38/40* (2013.01); *C22C 38/42* (2013.01); *C22C 38/44* (2013.01); *C22C 38/48* (2013.01); *C22C 38/58* (2013.01); *C21D 8/0226* (2013.01); *Y10T 428/12951* (2015.01); *Y10T 428/12993* (2015.01)

(58) Field of Classification Search

CPC ..... C22C 38/02; C22C 38/04; C22C 38/40; C22C 38/42; C22C 38/44; C22C 38/48; C22C 38/58; Y10T 428/12993; Y10T 428/12951

USPC ..... 428/687

See application file for complete search history.

(56) References Cited

U.S. PATENT DOCUMENTS

| | | | | |
|---|---|---|---|---|
| 6,329,081 | B1 | 12/2001 | Fudanoki et al. | |
| 2008/0233456 | A1 * | 9/2008 | Ishikawa et al. | 429/34 |

FOREIGN PATENT DOCUMENTS

| | | | |
|---|---|---|---|
| JP | 8-103801 | A | 4/1996 |
| JP | 2000-233205 | A | 8/2000 |
| JP | 2001-020045 | A | 1/2001 |
| JP | 2002-361303 | A | 12/2002 |
| JP | 2003-159764 | A | 6/2003 |
| JP | 3587180 | B2 | 11/2004 |
| JP | 2005-211975 | A | 8/2005 |
| JP | 3956346 | B2 | 8/2007 |
| JP | 4226131 | B2 | 2/2009 |
| JP | 2011-202253 | * | 10/2011 |
| JP | 2011-202253 | A | 10/2011 |
| JP | 2011-214079 | * | 10/2011 |
| JP | 2011-214079 | A | 10/2011 |

OTHER PUBLICATIONS

Machine Translation, Kawagoe Takashi, JP 2011-202253, Oct. 2011.*

Machine Translation, Kawagoe Takashi, JP 2011-214079, Oct. 2011.*

International Search Report dated May 1, 2012, which issued during the prosecution of International Patent Application No. PCT/JP2012/058705.

* cited by examiner

*Primary Examiner* — Michael E La Villa
(74) *Attorney, Agent, or Firm* — Troutman Sanders LLP

(57) ABSTRACT

A stainless steel plate is manufactured by performing temper rolling using a dull roller after the finish cold rolling and bright annealing. The stainless steel plate has an arithmetic mean roughness Ra of 0.2 to 1.2 μm in a direction perpendicular to the rolling direction of the steel plate surface. Furthermore, the stainless steel plate has a transfer ratio of 15 to 70% which is an area ratio of a portion onto which a dull pattern is transferred relative to the steel plate surface. In addition, the micro-pits being formed in the steel plate surface, having a depth of 0.5 μm or more, and having an opening area of 10 $\mu m^2$ or more, have an existing density in the steel plate surface of 10.0 or less per 0.01 $mm^2$, and an opening area ratio in the steel plate surface of 1.0% or less.

6 Claims, No Drawings

STAINLESS STEEL PLATE

CROSS-REFERENCE TO RELATED APPLICATIONS

This is a U.S. national phase application under 35 U.S.C. §371 of International Patent Application No. PCT/JP2012/058705, filed on Mar. 30, 2012, and claims benefit of priority to Japanese Patent Application Nos. 2011-078323 and 2011-078324, both filed Mar. 31, 2011. The International Application was published on Oct. 4, 2012, as International Publication No. WO 2012/133837 under PCT Article 21(2). The entire contents of these applications are hereby incorporated by reference.

TECHNICAL FIELD

The present invention relates to a stainless steel plate having excellent washability and anti-glare property, and a method of manufacturing the same.

BACKGROUND ART

In an exterior building material, an interior building material, and kitchen equipment etc., an austenitic stainless steel plate represented by SUS304 and SUS316, and a ferritic stainless steel plate represented by SUS430 are often used. When used for such purposes, the stainless steel plate is not only required to have washability in order to facilitate easy removal of various types of dirt that adhere during manufacturing of the product and construction, as well as various types of dirt and fingerprints that adhere at the time of daily use, but in order for the dirt, fingerprints, and handling flaws to be hardly visible, an anti-glare property is also considered to be important.

Furthermore, in the field of precision equipment and electronic device members, for example, high speed and high density are required for an HDD (hard disk drive). The materials used for HDD members such as a rotating member, an arm member, a case member, and a cover, for example, not only possess excellent corrosion resistance, but are managed strictly with regard to dirt, such as particles (adhesive particles) and outgas. In addition, in a washing process during the manufacture of HDD members, for example, after degreasing with hydrocarbon, careful washing, such as ultrasonic cleaning, is performed by using a fluorine-based cleaning solution, a weak alkali-based cleaning solution, and extra pure water. Furthermore, if necessary, by performing vapor washing and finally performing a rinsing process a plurality of times using extra pure water, not only particles, but also ionic materials are removed. In addition, even minute dirt present in the air during the washing process can become a source of contamination, and therefore, generally, washing is performed in a Class 5 or higher clean environment according to JIS B9920. It must be noted that Class 5 or higher according to JIS B9920 is an environment in which the number of 0.1 μm particles per 1 $m^2$ of air is 100000 or less, the number of 0.2 μm particles is 23700 or less, the number of 0.3 μm particles is 10200 or less, the number of 0.5 μm particles is 3520 or less, the number of 1 μm particles is 832 or less, and the number of 5 μm particles is 29 or less.

For the HDD members manufactured through such a washing process, ordinary steel, aluminum alloy, and stainless steel etc., are used, which are often used when non-electrolytic Ni plating has been performed. A main purpose of performing non-electrolytic Ni plating is to impart corrosion resistance and improve washability; however, such HDD members are required to have not only corrosion resistance and washability, but also a matte-finish surface having an anti-glare property so that fingerprints and minute flaws are hardly visible.

PTL 1 describes a stainless laminated damping steel plate having excellent anti-contamination properties for precision equipment covers such as HDD case covers. Ina normal stainless steel plate, if annealing and acid pickling are performed, a Cr depleted layer generated by annealing near the grain boundary in the vicinity of the surface is scarfed preferentially by acid pickling, and a small groove (micro groove) is formed along the grain boundary. The microgroove becomes a cause of occurrence of outgas due to the retention of an oil content when acid pickling is insufficient. Furthermore, dust adheres easily onto the micro groove, due to which the washability declines. Thus, in PTL 1, in order to prevent the occurrence of the micro groove, bright annealing or non-oxidation annealing is performed as the finish annealing after cold rolling.

Furthermore, PTL 2 describes a stainless steel plate in which the number of pin holes exceeding 0.25 $mm^2$ in size on the surface of a temper-rolled plate is decreased to 10 or less per 10 $cm^2$ so as to make it difficult for the minute dust and dirt in the air to adhere. The steel plate is manufactured by combining mechanical polishing, reduction annealing, and temper rolling by using a water-soluble lubricant.

In addition, PTL 3 describes a stainless steel plate having excellent fouling resistance and corrosion resistance. In such a steel plate, the fouling resistance and corrosion resistance are improved by controlling the surface roughness by performing bright annealing after finish rolling by using a dull roller.

Furthermore, PTL 4 describes a stainless steel plate having excellent contamination resistance, washability, and anti-glare property. The steel plate is manufactured by performing a first temper rolling with a mirror-finished roller after the finish annealing, and then performing a second temper rolling by using a dull roller.

CITATION LIST

Patent Literature

PTL 1: Japanese Patent Publication No. 3956346
PTL 2: Japanese Laid-Open Patent Publication No. 2001-20045
PTL 3: Japanese Patent Publication No. 3587180
PTL 4: Japanese Patent Publication No. 4226131

SUMMARY OF INVENTION

Technical Problem

However, if only bright annealing or non-oxidation annealing is applied as the finish annealing and acid pickling is skipped, as in the case of the stainless steel plate according to PTL 1, it is believed that good washability is not obtained for dirt such as minute particles.

Furthermore, the washability of the stainless steel plate according to PTL 2 is evaluated in a test in which a sample for which the exposure test has been completed is wiped only once with a cloth immersed in a neutral detergent, and judging from the surface properties of the stainless steel plate of PTL 2, it is believed that good washability for dirt such as minute particles is not obtained.

Here, the washability and the anti-glare property conflict with each other, and for example, a stainless steel plate having excellent anti-glare property has a large surface unevenness, and therefore, it is easy for dirt to adhere and difficult to remove the dirt for which the washability declines.

Therefore, in the stainless steel plate according to PTL 3, while the anti-glare property can be improved, the washability has not been considered, and it is believed that good washability is not obtained for dirt such as minute particles.

Furthermore, as in the case of the stainless steel plate according to PTL 4, while the anti-glare property can be improved by controlling only the surface roughness, it is believed that good washability is not obtained for dirt such as minute particles.

The present invention has been achieved in view of such points, and an object thereof is to provide a stainless steel plate having excellent washability and anti-glare property, and a method of manufacturing the same.

Solution to Problem

A stainless steel plate according to an aspect of the present invention is a stainless steel plate for which temper rolling is performed by using a dull roller after the finish cold rolling and bright annealing, wherein the arithmetic mean roughness Ra in a direction perpendicular to the rolling direction of the steel plate surface is 0.2 to 1.2 μm; the transfer ratio, which is an area ratio of a portion onto which a dull pattern is transferred relative to the steel plate surface, is 15 to 70%; and a micro-pit, being formed in the steel plate surface, having a depth of 0.5 μm or more, and having an opening area of 10 $\mu m^2$ or more, has an existing density in the steel plate surface of 10.0 or less per 0.01 $mm^2$, and an opening area ratio in the steel plate surface of 1.0% or less.

The stainless steel plate according to an example of the aspect is a ferritic stainless steel plate based on the stainless steel plate according to the aspect of the present invention, containing: on the basis of percent by mass, C at 0.15% or less, Si from 0.1 to 2.0%, Cr from 10 to 32%, and at least either one of Nb from 0.01 to 0.8% or Ti from 0.01 to 0.5%, with residue being Fe and unavoidable impurities.

The stainless steel plate according to another example of the aspect is the stainless steel plate according to the example of the aspect, containing, on the basis of percent by mass, at least either one of Mo from 0.2 to 5% or Cu from 0.1 to 3.0%.

The stainless steel plate according to yet another example of the aspect is the ferritic stainless steel plate based on the stainless steel plate according to the aspect of the present invention, containing, on the basis of percent by mass, C at 0.15% or less, Si at 2% or less, Mn at 2% or less, P at 0.04% or less, S at 0.03% or less, Ni at 0.6% or less, Cr from 11 to 32%, Mo from 0 to 3%, Cu from 0 to 1%, Nb from 0 to 1%, Ti from 0 to 1%, Al from 0 to 0.12%, N at 0.025% or less, and B from 0 to 0.01%, with residue being Fe and unavoidable impurities.

The stainless steel plate according to a further example of the aspect is an austenitic stainless steel plate based on the stainless steel plate according to the aspect of the present invention, containing, on the basis of percent by mass, C at 0.15% or less, Si at 4% or less, Mn at 10% or less, P at 0.045% or less, S at 0.03% or less, Ni from 1 to 28% or less, Cr from 16 to 32% or less, Mo from 0 to 10%, Cu from 0 to 3.5%, Nb from 0 to 1%, Ti from 0 to 1%, Al from 0 to 0.1%, N at 0.3% or less, and B from 0 to 0.01%, with residue being Fe and unavoidable impurities.

The method of manufacturing a stainless steel plate according to another aspect of the present invention is a method of manufacturing a stainless steel plate comprising: after performing at least finish cold rolling, bright annealing performed, as the finish annealing, for a hot-rolled steel plate, and then temper rolling performed by using a dull roller, wherein a total cold rolling ratio until bright annealing is 70% or less; a cold rolling ratio during the finish cold rolling is 30% or less; and at least in a final rolling pass, rolling is performed at a rolling ratio of 15% or higher and a rolling speed of 200 mm/min or less by using a work roller having an arithmetic mean roughness Ra of 0.3 μm or less.

The method of manufacturing a stainless steel plate according to an example of the another aspect is the method of manufacturing a stainless steel plate according to the another aspect of the present invention, wherein during temper rolling, rolling is performed for one or more passes at an elongation ratio in one pass of 0.5% or less by using a dull roller having a roller diameter of 500 mm or more and an arithmetic mean roughness Ra of 1.0 to 3.5, and a total elongation ratio is 0.2 to 1.4%.

The stainless steel plate according to another further example of the aspect is a ferritic stainless steel plate based on the stainless steel plate according to the aspect of the present invention, which is used for any of a hard disk drive member, a solar cell substrate material, a precision equipment member, an electronic device member, a digital equipment member, and a computer member.

Advantageous Effects of Invention

According to the present invention, the washability is improved by controlling the micro-pits that are the cause of adherence of dirt, and temper rolling is performed under conditions in which the opening and occurrence of micro-pits are restrained, and therefore, it is possible to improve the anti-glare property while maintaining washability.

DESCRIPTION OF EMBODIMENTS

One embodiment of the present invention will be explained.

A stainless steel plate according to one embodiment is a steel plate that is temper rolled by using a dull roller after bright annealing, in which the washability is improved by controlling the micro-pits that are trap sites of particles for example, and are also the cause of hindrance to washability due to the adherence of dirt, and the anti-glare property is improved while maintaining washability by performing temper rolling by using a dull roller under conditions in which the opening and occurrence of micro-pits is restrained.

First, surface properties of the stainless steel plate will be explained.

It was found that the minute pits distributed on the surface of the stainless steel plate greatly influence the washability that facilitates the ease of removal of the dirt adhering to the surface of the stainless steel plate. A pit is a fine recess on the surface of the steel plate. Such a pit primarily occurs as a result of cracks during the hot rolling process, recesses occurring in the gaps of grain boundary oxidation units, and in the gaps of grain boundary corrosion units and different particles such as inclusions and carbides, recesses occurring as a result of falling traces of such particles and jamming of metal particles or other particles during the manufacturing process, recesses occurring due to falling traces of oxide scale residue matter and inclusion of rolling oil during cold rolling, and also due to fine surface defects caused by mismatch of cold rolling conditions and processing cracks caused by inclusions during cold forming.

Among such pits, micro-pits having a depth of 0.5 μm or more and an opening area of 10 $\mu m^2$ or more are particularly prone to becoming trap sites for impurities, thus becoming a major cause of hindrance to washability. Thus, as a result of detailed examination, a stainless steel plate in which micro-pits formed on the surface of the steel plate have an existing density of 10.0 or less per 0.01 $mm^2$, and an opening area ratio of the micro-pits of 1.0% or less, is found to exhibit good washability in a washing process performed in a Class 5 or higher clean environment according to JIS B9920.

It must be noted that crater-like recesses having a size of a few tens of micrometers onto which a dull pattern is transferred through dull roller rolling do not correspond to micro-pits controlled in one embodiment; however, pits are retained as is inside a crater when a dull pattern is transferred onto a micro-pit portion that existed prior to dull roller rolling, and new pits that have opened or are generated inside a crater correspond to micro-pits.

Here, the depth of a pit is the maximum depth of the pit calculated by using, as a reference, an average height of the diagonals on the outer periphery of the pit. It must be noted that the depth of a pit in the case when a pit exists inside a crater onto which a dull pattern is transferred is similarly the maximum depth of the pit calculated by using, as a reference, the average height of the diagonals on the outer periphery of the pit. Furthermore, the opening area of a pit is a projected area of a portion enclosed by the edges of the pit in a plan view of the steel plate surface in the direction of the plate thickness.

The measurement of the depth and the opening area of a pit is preferably performed by using a laser microscope and a white light interference microscope capable of measuring the shape of a surface. It is set that the measurement area derived by such a measurement is a total area of 0.1 $mm^2$ or more formed of a plurality of fields of view selected randomly from the steel plate surface. For example, 20 fields of view or more may be observed at a magnification of 1000 times, and the existing density and opening area ratio of micro-pits may be calculated. The existing density is calculated by measuring the number of micro-pits (including the micro-pits in which a part of the pit opening is projecting from the boundary of the measurement region) that exist within the measurement region set in each field of view, dividing the sum of the measured quantity in each measurement region by the total area of the entire measurement region area, and then converting it to the number per 0.01 $mm^2$. Furthermore, the opening area ratio is calculated by determining the total opening area of coarse micro-pits (for micro-pits in which a part of the pit opening is projecting from the boundary of the measurement region, only the area of the portion positioned within the measurement region is included) that exist within the measurement region set in each field of view, and then dividing the sum of the total opening areas in each measurement region by the entire measurement region area.

A matte-finish surface such as a dull pattern is suitable as a design of an HDD member, and as a standard, the glossiness stipulated in JISZ8741, that is the value at 20° is preferably 400 or less. In addition, by performing temper rolling by using a dull roller, the surface glossiness is reduced and the anti-glare property is imparted.

An arithmetic mean roughness (Ra) of the steel plate surface that is thus temper rolled by using a dull roller is a measured value as stipulated in JIS B0601, and is a measured value in a direction perpendicular to the rolling direction. To secure a sufficient anti-glare property, Ra is required to be 0.2 μm or more. However, when the unevenness of the steel plate surface increases thus increasing the Ra, and the Ra exceeds 1.2 μm, the washability declines. Therefore, the Ra of the steel plate surface was set to 0.2 μm or more and 1.2 μm or less.

Furthermore, a transfer ratio, which is an area ratio of a portion onto which a dull pattern is transferred by temper rolling relative to the steel plate surface, is a percentage of a projected area of a portion enclosed by the diagonals of the crater part onto which the dull pattern is transferred relative to the total area, in a plan view of the steel plate surface in the direction of the plate thickness. For example, the transfer ratio may be calculated by observing 20 fields of view or more at a magnification of 400 times by an optical microscope or the like, and then measuring the area ratio of the crater part onto which the dull pattern is transferred.

Here, the washability and the anti-glare property conflict with each other, and while the washability becomes better when the transfer ratio is low, the anti-glare property declines and the surface glossiness becomes too high. On the contrary, when the transfer ratio becomes too high, it is possible to have a state where the surface glossiness declines and the anti-glare property is good, however, the unevenness of the surface becomes large resulting in a decline in washability.

Thus, specifically, if the transfer ratio is less than 15%, the anti-glare property is poor, making dirt, fingerprints, and handling flaws easily visible. On the other hand, if the transfer ratio exceeds 70%, the anti-glare property is sufficient; however, the opening and occurrence of micro-pits inside the craters onto which the dull pattern is transferred increases, due to which the washability declines significantly. Therefore, the transfer ratio on the steel plate surface was set to 15% or higher and 70% or lower.

Next, an element composition of the stainless steel plate according to one embodiment will be explained.

The present stainless steel plate is a ferritic stainless steel plate containing, on the basis of percent by mass, C at 0.15% or less, Si from 0.1 to 2.0%, Cr from 10 to 32%, and at least either one of Nb from 0.01 to 0.8% or Ti from 0.01 to 0.5%, with residue being Fe and unavoidable impurities.

C is a solute strengthening element, which is an essential component, however, if the concentration of C is high, the Cr carbide that precipitates at the crystal grain boundary increases. A Cr depleted layer having a low Cr concentration is generated near the Cr carbide from where micro-pits are generated easily. Furthermore, during temper rolling by using a dull roller, C causes micro-pits to open and also generates new micro-pits, thus deteriorating the washability. Therefore, the C content was set to 0.15% by mass or less.

Si is an alloy element that improves the corrosion resistance and strength, and is also a component used for the deoxidization of molten steel. If the Si content is less than 0.1% by mass, insufficient deoxidization ensues, and nonmetallic inclusions that induce processing cracks are generated easily. Furthermore, if Si is added in excess beyond 2.0% by mass, it becomes a cause of deterioration of manufacturability. Therefore, the content of Si was set to 0.1% by mass or more and 2.0% by mass or less.

Cr is an alloy component necessary for the improvement of corrosion resistance, and requires addition of 10% by mass or more. However, if Cr is added in large amounts beyond 32% by mass, the manufacturability declines. Therefore, the Cr content was set to 10% by mass or more and 32% by mass or less.

Nb is an important alloy component that improves washability by generating a precipitate through the adherence of C and N within the steel as Nb (C, N), and restraining the generation of Cr carbide which is one of the causes of occurrence of micro-pits. Such an effect is exhibited remarkably when the content of Nb is 0.01% by mass or more. However, if Nb is added in excess beyond 0.8% by mass, the manufacturability and processability decline. Therefore, if Nb is contained, the content was set to 0.01% by mass or more and 0.8% by mass or less.

Same as Nb, Ti is an important alloy component that improves washability by generating a precipitate through the adherence of C and N within the steel as Nb (C, N), and restraining the generation of Cr carbide which is one of the causes of occurrence of micro-pits. Such an effect is exhibited remarkably when the content of Ti is 0.01% by mass or more. However, if Ti is added in excess beyond 0.5% by mass, the productivity and processability decline. Therefore, if Ti is contained, the content was set to 0.01% by mass or more and 0.5% by mass or less.

With the purpose of improving corrosion resistance, if necessary, at least either one of Mo or Cu may be contained. If Mo is contained, the content was set to 0.2% by mass or more and 5% by mass or less, and if Cu is contained, the content was set to 0.1% by mass or more and 3.0% by mass or less.

Furthermore, in addition to the above alloy components, other alloy components may also be contained, if necessary. For example, with the purpose of improving corrosion resistance and processability, at least any one of Mn at 2% by mass or less, Zr at 0.01% by mass or more and 0.5% by mass or less, Y at 0.05% by mass or less, W at 1% by mass or less, Ag at 0.5% by mass or less, Sn at 0.5% by mass or less, and Co at 1% by mass or less, for example, may be added. Furthermore, as long as P, which is included as an impurity, is controlled at 0.05% by mass or less, and S is controlled at 0.01% by mass or less, no adverse effect is exerted on properties.

In addition to such a ferritic stainless steel plate, a stainless steel plate equivalent to the ferritic stainless steels stipulated in JIS G4305:2005 and JIS G4303:2005, for example, may be used. In addition to the above ferritic stainless steels, a ferritic stainless steel plate containing C at 0.15% by mass or less, Si at 2% by mass or less, Mn at 2% by mass or less, P at 0.04% by mass or less, S at 0.03% by mass or less, Ni at 0.6% by mass or less, Cr at 11% by mass or more and 32% by mass or less, Mo at 3% by mass or less (including a case of no addition), Cu at 1% by mass or less (including a case of no addition), Nb at 1% by mass or less (including a case of no addition), Ti at 1% by mass or less (including a case of no addition), Al at 0.12% by mass or less (including a case of no addition), N at 0.025% by mass or less, and B at 0.01% by mass or less (including a case of no addition), with residue being Fe and unavoidable impurities, may also be used.

Moreover, not only ferritic stainless steels, but austenitic stainless steels, for example, an austenitic stainless steel equivalent to the austenitic stainless steels stipulated in JIS G4305:2005 and JIS G4303:2005 may be used. In addition to the above austenitic stainless steels, an austenitic stainless steel plate containing C at 0.15% or less, Si at 4% by mass or less, Mn at 10% by mass or less, P at 0.045% by mass or less, S at 0.03% by mass or less, Ni at 1% by mass or more and 28% by mass or less, Cr at 16% by mass or more and 32% by mass or less, Mo at 10% by mass or less (including a case of no addition), Cu at 3.5% by mass or less (including a case of no addition), Nb at 1% by mass or less (including a case of no addition), Ti at 1% by mass or less (including a case of no addition), Al at 0.1% by mass or less (including a case of no addition), N at 0.3% by mass or less, and B at 0.01% by mass or less (including a case of no addition), with residue being Fe and unavoidable impurities, may also be used.

Thus, according to the above stainless steel plates, it is possible to improve the washability because it is possible to control the occurrence status of micro-pits that act as trap sites including particles and are the cause of adherence of dirt, and it is possible to improve the anti-glare property because temper rolling is performed under conditions in which the opening and occurrence of micro-pits are restrained.

Next, a method of manufacturing the above stainless steel plates will be explained.

In order to manufacture a stainless steel plate having excellent washability and anti-glare property, it is important to manufacture a smooth stainless steel original plate having a small number of micro-pits and excellent washability through annealing, acid pickling, cold rolling, and bright annealing, and then subjecting the original plate to temper rolling under low pressure using a dull roller, thereby imparting the anti-glare property while maintaining washability.

First, using a hot-rolled steel plate manufactured by the conventional method as the starting material, rough and large impurities such as metal and scale are removed by the annealing and acid pickling processes.

Next, by securing a sufficient rolling ratio through finish cold rolling and by performing rolling under low speed and high pressure conditions in the final stage using a work roller having a high smoothness, the recesses (falling traces) generated by acid pickling and the recesses caused by grain boundary corrosion can be smoothened out as much as possible. Also, by sufficiently increasing the total cold rolling ratio at the same time, the recesses originating from the hot-rolled steel plate, and recesses such as the falling traces of impurities that have fallen in the annealing and acid pickling processes can be smoothened out as much as possible.

Furthermore, by performing bright annealing as the finish annealing after the finish cold rolling, the formation of recesses due to surface oxidation is prevented, and the subsequent acid pickling process becomes unnecessary, and a stainless steel original plate having excellent washability is manufactured by eliminating grain boundary corrosion caused by acid pickling.

Thus, with regard to the present stainless steel original plate, by performing temper rolling by using a dull roller under conditions in which the opening and occurrence of micro-pits can be restrained, the anti-glare property is imparted while maintaining washability.

It must be noted that at the time of manufacturing a stainless steel plate, a hot-rolled steel plate may be used as the starting material, and bright annealing may be performed as finish annealing after performing at least the finish cold rolling, and then temper rolling may be performed by using a dull roller. As a specific manufacturing procedure, for example, the stainless steel plate can be manufactured by procedure (1) that includes performing the processes of annealing, acid pickling, finish cold rolling, finish annealing (bright annealing), and temper rolling, in that order, from a hot-rolled steel plate. Furthermore, the procedure (2) that includes performing the processes of annealing, acid pickling, cold rolling, annealing, acid pickling, finish cold rolling, finish annealing (bright annealing), and temper rolling, in that order, from a hot-rolled steel plate may also be used. In addition, the procedure (3) that includes performing the processes of annealing, acid pickling, cold rolling 1, annealing 1, acid pickling 1, cold rolling 2, annealing 2, acid pickling 2, finish cold rolling, finish annealing (bright annealing), and temper rolling, in that order, from a hot-rolled steel plate may also be used. Also, the procedure (4) that includes performing the processes of annealing, acid pickling, cold rolling, bright annealing, finish cold rolling, finish annealing (bright annealing), and temper rolling, in that order, from a hot-rolled steel plate may also be used.

It must be noted that the hot-rolled steel plate is a steel plate that has been hot rolled without performing cold rolling. In the hot-rolled steel plate, melting, casting, and hot rolling of the stainless steel is performed according to the conventional method, and if necessary, hot-rolled annealing and acid pickling are performed.

Furthermore, bright annealing is an annealing process performed in a reducing atmosphere, and the conditions for bright heat treatment applicable in BA finishing (JIS G203: 2009, number 4225) can be adopted.

In addition, finish cold rolling is a cold rolling process performed after the last annealing and immediately before bright annealing, and as regard the number of passes, there may be either a single pass or a plurality of passes. Further, for example, a plurality of different types of rolling machines such as the general Sendzimir mill and a thin-plate dedicated mill may be used one after the other. The cold rolling ratio of the finish cold rolling when different rolling machines are used one after the other is the total cold rolling ratio based on the plurality of rolling machines.

Furthermore, if necessary, a polishing process and a degreasing process are added to the above procedures (1) through (4), and after the last temper rolling, the plate may also be passed through degreasing and refining processes such as a tension leveler and slit to the extent that the surface properties are not affected.

Next, the specific manufacturing conditions for such a manufacturing method will be described.

[Total Cold Rolling Ratio: 70% or Higher]

First, the total cold rolling ratio is the total rolling ratio of cold rolling in a series of processes at the time of manufacturing a stainless steel plate. For example, in the above procedure (1), the total cold rolling ratio is the rolling ratio of the finish cold rolling, in the above procedure (2), the total cold rolling ratio is the total rolling ratio of cold rolling and finish rolling, in the above procedure (3), the total cold rolling ratio is the total rolling ratio of cold rolling 1, cold rolling 2, and finish cold rolling, and in the above procedure (4), the total cold rolling ratio is the total rolling ratio of cold rolling and finish rolling. In addition, when the plate thickness before the first cold rolling pass is $h_0$ (mm) and the plate thickness after the last cold rolling pass is $h_1$ (mm), the total cold rolling ratio is expressed by $(h_0-h_1)/h_0\times100(\%)$.

Here, deep surface defects often occur at the time of hot rolling, and in order to eliminate as many micro-pits as possible, it is important to increase the total cold rolling ratio until the bright annealing process so as to sufficiently stretch the surface defects that exist in the hot-rolled steel plate, which is the starting material. Furthermore, the impurities embedded near the steel plate surface may possibly fall due to hot-rolled plate annealing and acid pickling before cold rolling, and an increase in the total cold rolling ratio is also effective at stretching the falling traces. Also, it was understood from the results of various examinations that the surface defects could be effectively eliminated by setting the total cold rolling ratio until bright annealing to 70% or higher. Therefore, the total cold rolling ratio until bright annealing was set to 70% or more. It must be noted that being restricted by the material deformation resistance and the capacity of the cold rolling machine in use, the upper limit of the total cold rolling ratio is not particularly specified, but is generally 98% or lower.

[Annealing and Acid Pickling]

Annealing and acid pickling are effective processes for the removal of rough and large impurities such as metal and scale adhering to the steel plate surface. In view of the manufacturability and characteristics of the material, appropriate conditions can be selected for annealing. Furthermore, depending on the material, either one of batch annealing or continuous annealing may be adopted as long as the surface properties are not affected. Moreover, acid pickling may be performed by a combination of a neutral salt and acids such as sulfuric acid, nitric acid, hydrofluoric acid, and hydrochloric acid and electrolytic acid pickling may also be performed.

[Finish Cold Rolling]

Finish cold rolling is an important process in determining the surface condition of a stainless steel plate. That is, since it is necessary to stretch a recess so that a micro-pit can attain the controlled existing density and the opening area ratio, it is important to sufficiently stretch the falling traces of impurities occurring during acid pickling and the recesses formed by grain boundary corrosion. To thus stretch the recesses, it is necessary to set the rolling ratio of finish cold rolling to 30% or higher. Furthermore, the rolling ratio of finish rolling is preferably 40% or higher, and more preferably 50% or higher. On the other hand, being restricted by the material deformation resistance and the capacity of the cold rolling machine in use, the upper limit of the finish rolling is not particularly specified, but is generally 90% or lower.

Furthermore, in order to obtain a steel plate surface that is as smooth as possible, it is effective to use a work roller of which the arithmetic mean roughness Ra of the surface of the roller is adjusted to 0.3 μm or less at least in the final rolling pass during finish cold rolling. Furthermore, the rolling ratio in the final rolling pass using a work roller having Ra of 0.3 μm or less must be set to 15% or higher. In addition, in order to prevent the opening and occurrence of micro-pits due to the inclusion of rolling oil in the work roller and the steel plate surface, the rolling speed during the final rolling pass must be set to 200 m/min or less.

[Bright Annealing]

In order to maintain the surface property of having an extremely small number of micro-pits that is achieved through finish cold rolling, it is important to be able to prevent surface oxidation during finish annealing, and skip the subsequent processes of removing oxidation scales such as acid pickling and polishing. Thus, bright annealing in a reducing atmosphere is performed as the finish annealing. As for the conditions for the bright annealing, the conditions for manufacturing a normal BA finish stainless steel plate can be applied. The atmospheric gas used during bright annealing is preferably hydrogen gas, or a mixed gas containing hydrogen and nitrogen, for example. The annealing temperature can be set appropriately according to the components of the steel plate, the plate thickness, and the purposes, however, for a ferritic stainless steel, the annealing temperature may be set in the range of 800 to 1100° C., for example, and for an austenitic stainless steel, the annealing temperature may be set in the range of 1000 to 1100° C., for example. It must be noted that if necessary, degreasing may be performed immediately before bright annealing.

[Temper Rolling]

By performing temper rolling by using a dull roller as the work roller after bright annealing, a dull pattern is transferred onto the steel plate surface, and the anti-glare property is imparted while maintaining the washability. During such temper rolling, it is important to control the dull rolling conditions so as to be able to restrain the opening and occurrence of micro-pits inside the crater onto which the dull pattern is transferred, and impart the anti-glare property without causing deterioration in washability.

First, if the diameter of the dull roller is less than 500 mm, more than necessary amount of stress is applied to the crater part onto which the dull pattern is transferred, resulting in an increase in the opening and occurrence of micro-pits inside the crater.

Furthermore, it was understood that as for the surface roughness of the dull roller in use, as long as the arithmetic mean roughness Ra is in a range of 1.0 μm or more and 3.5 μm or less, the anti-glare property can be imparted, and the washability can be maintained.

In addition, as regards the pass schedule of temper rolling, if the elongation ratio of one pass is higher than 0.5%, it results in an increase in the opening and occurrence of micro-pits inside the crater, and therefore, the elongation ratio of one pass was set to 0.5% or less. Moreover, if temper rolling is performed over a plurality of passes even when the total elongation ratio is the same, the opening and occurrence of micro-pits inside the crater onto which the dull pattern is transferred can be restrained further, which makes it preferable.

Furthermore, it was understood that under the above pass conditions, if the total elongation ratio of temper rolling is in the range of 0.2% or more and 1.4% or less, the anti-glare property can be imparted, and washability can be maintained.

Therefore, during temper rolling, the diameter of the dull roller was set to 500 mm or more, the arithmetic mean roughness Ra of the dull roller was set to 1.0 μm or more and 3.5 μm or less, the elongation ratio of one pass was set to 0.5% or less, and the total elongation ratio was set to 0.2% or more and 1.4% or less.

Lubricants blended with additives for the purpose of preventing rust may also be used during such temper rolling. Furthermore, in order to remove impurities from the surface of the work roller, a washing liquid may be used, which may be wiped off with a wiper.

Thus, according to the above method of manufacturing a stainless steel plate, the opening and occurrence of micro-pits can be restrained, and a stainless steel plate having excellent washability and anti-glare property can be manufactured. Furthermore, the manufacturing process is industrially suitable, and particularly, excellent washability and anti-glare property can be imparted without performing surface processing such as non-electrolytic Ni plating, and as a result, a stainless steel plate having excellent washability and anti-glare property from an economic point of view can be manufactured.

It must be noted that in addition to the above manufacturing processes, a process of mechanical polishing and degreasing may also be added as long as the surface properties are not affected.

[Examples]

The examples and comparative examples of the present invention will be described below.

First, a stainless steel having the chemical composition shown in Table 1 and Table 2 was melted by passing through an electric furnace, a converter reactor, and the VOD process, and then continuous casting was performed to obtain a slab.

TABLE 1

| Types of steel | Content (% by mass) of alloy component | | | | | |
|---|---|---|---|---|---|---|
| | C | Si | Mn | Ni | Cr | Others |
| a | 0.07 | 0.40 | 0.80 | 8.1 | 18.3 | Mo: 0.12 |
| b | 0.01 | 0.50 | 0.80 | 0.1 | 12.2 | |
| c | 0.07 | 0.55 | 0.14 | 0.1 | 16.3 | |
| d | 0.05 | 0.58 | 0.95 | 10.1 | 17.2 | Mo: 2.0 |
| e | 0.01 | 0.55 | 0.13 | 0.1 | 18.3 | Cu: 0.5, Nb: 0.40 |
| f | 0.01 | 0.45 | 0.18 | 0.1 | 21.7 | Mo: 0.70, Ti: 0.21, Nb: 0.40 |
| g | 0.06 | 0.55 | 6.4 | 4.2 | 18.4 | N: 0.1 |
| h | 0.13 | 0.93 | 2.7 | 2.5 | 16.3 | N: 0.11, Cu: 2.7% |

TABLE 2

| Types of steel | Content (% by mass) of alloy component | | | | | | |
|---|---|---|---|---|---|---|---|
| | C | Si | Mn | Cr | Ti | Nb | Others |
| i | 0.01 | 0.50 | 0.80 | 12.2 | 0.01 | <0.01 | |
| j | 0.01 | 0.91 | 1.08 | 14.1 | <0.01 | 0.30 | |
| k | 0.08 | 0.58 | 0.15 | 16.2 | 0.02 | <0.01 | |
| l | 0.01 | 0.44 | 0.15 | 17.3 | <0.01 | 0.35 | |
| m | 0.01 | 0.55 | 0.13 | 18.4 | <0.01 | 0.40 | Cu: 0.5 |
| n | 0.01 | 0.45 | 0.18 | 21.8 | 0.21 | 0.40 | Mo: 0.70 |

Next, the continuous-cast slab was subjected to hot rolling through the normal method to form a hot-rolled steel plate. Using the hot-rolled steel plate as the starting material, the processes were performed in the order of the above procedure (2) or procedure (3), and temper-rolled material having a plate thickness of 0.3 to 1.5 mm was prepared using a dull roller in the temper rolling process, which was used as the sample material for each example and comparative example. It must be noted that procedure (2) is adopted for stainless steel of steel type b and steel type j, and procedure (3) is adopted for the other steel types. Furthermore, in each of the present examples, a work roller having Ra of 0.3 μm or less was used in the finish cold rolling, and the rolling ratio during the final rolling pass was set to 15% or higher, while the rolling speed of the final rolling pass was set to 200 mm/min or less. In addition, bright annealing was performed in an atmosphere in which hydrogen constituted 75 to 100% by mass, and the remainder was nitrogen.

The manufacturing conditions and the final plate thickness of each example and comparative example are described in Table 3 and Table 4. It must be noted that in some comparative examples, instead of bright annealing, annealing and acid pickling were performed as the finish annealing, and electrolytic acid pickling was performed after bright annealing. In Table 3 and Table 4, the steel plates for which annealing and acid pickling were performed as the finish annealing were indicated as AP (mixed acid), and the steel plates for which electrolytic acid pickling was performed were indicated as AP (electrolytic). Furthermore, both surfaces of each sample material were finished according to the same conditions.

The sample material of each example and comparative example was used to perform various measurements concerning washability and anti-glare property. As described in Table 3, measurements concerning the washability were similarly performed for a non-electrolytic Ni-plated material used for HDD members as a material for which the washability is evaluated.

[Measurement of Arithmetic Mean Roughness of the Steel Plate Surface]

The 50 mm square samples cut out from each sample material were subjected to ultrasonic cleaning with acetone, following which the arithmetic mean roughness (Ra) was measured by a method conforming to JIS B0601. Furthermore, the arithmetic mean roughness was measured three times in a direction perpendicular to the rolling direction, and the mean value was calculated and evaluated. The measurement results of the arithmetic mean roughness of each sample are shown in Table 3 and Table 4.

[Measurement of Transfer Ratio]

The 50 mm square samples cut out from each sample material were subjected to ultrasonic cleaning with acetone, following which the surface was observed through an optical microscope, and the transfer ratio, which is the area ratio of the crater part onto which the dull pattern is transferred, was calculated. Furthermore, during the observation of the surface, the observation magnification was set to 400 times, the number of observation fields was set to 20 fields of view, and the mean value of all measured values was calculated and evaluated. The measurement results of the transfer ratio of each sample are shown in Table 3 and Table 4.

[Measurement of Micro-Pits]

The 50 mm square samples cut out from each sample material were subjected to ultrasonic cleaning with acetone, following which the surface was observed through a laser microscope, and the existing density and opening area ratio was calculated for a micro-pit having a depth of 0.5 μm and an opening area of 10 $\mu m^2$. Furthermore, during the observation of the surface, the observation magnification was set to 1000 times, the number of observation fields was set to 10, and the total measurement region area was set to 0.1 $mm^2$. The measurement results of the existing density and opening area ratio of the micro-pits in each sample are shown in Table 3 and Table 4.

[Measurement of Surface Glossiness]

The 50 mm square samples cut out from each sample material were subjected to ultrasonic cleaning with acetone, following which the surface glossiness (20°) was measured according to a method conforming to JIS 28741. Furthermore, the surface glossiness was measured three times in each of the direction parallel to the rolling direction and the direction perpendicular to the rolling direction, and the mean value was calculated and evaluated. The measurement results of the surface glossiness of each sample are shown in Table 3 and Table 4.

[Evaluation of Washability]

The 50 mm square samples cut out from each sample material were subjected to a washing operation by the procedure described below, and specimens for the measurement of surface washability were obtained. It must be noted that the processes after acetone degreasing in the washing operation, and all processes in the measurement of surface washability were performed in a Class 5 clean environment according to JIS B9920.

In the washing operation of the samples, first of all, degreasing was performed through ultrasonic cleaning using acetone. The degreased samples were subjected to ultrasonic cleaning by using a fluorine-based cleaning solution, following which steam cleaning and vacuum drying were performed. Then, ultrasonic cleaning was performed by using a weak alkaline-based detergent, rinsing was performed through immersion in ultra pure water, and hot-air drying was performed by pulling up the samples at a low speed.

The surface washability was measured as described below using an LPC (Liquid Particle Counter) device. First, ultra pure water for immersing the specimen for washability measurement was poured in a beaker and the beaker was set in the LPC device, following which the number of particles present in the ultra pure water and the size distribution of particles was measured. From the measurement data of the ultra pure water, the number of particles having a particle diameter of 0.3 μm or more was calculated, and the calculated value was set as the particle count (blank measurement value) prior to immersion of the specimen. Next, the specimen for washability measurement was immersed in the beaker filled with ultra pure water and ultrasonic cleaning was performed for a fixed period of time, following which the particles adhering to the surface of the specimen were extracted in the ultra pure water. After this, the numbers of particles present in the ultra pure water and the size distribution of particles were measured with the LPC device, and the number of particles having a particle diameter of 0.3 μm or more was calculated. The difference between the calculated value and the blank measurement value was set as the number of particles extracted from the specimen for washability measurement. When measuring the number of particles and the size distribution, the measurement was performed three times or more with the LPC device using the same liquid, and the mean value was set as the measured value. Furthermore, measurement was performed based on the test count n=3 using three samples of the same type of specimen, and the mean value was determined to be the number of particles adhering and remaining in the specimen for washability measurement. In addition, from the value of the number of particles, the particle adhesion count (number of particles adhering to the surface) per unit area of the steel plate surface was calculated. The results are shown in Table 3 and Table 4. The washability was evaluated to be good when the particle adhesion count is 1000/$cm^2$ or less.

TABLE 3

| | | Cold Rolling | Finish Cold Rolling Condition | | | | | Dull roller temper rolling conditions | | | | |
|---|---|---|---|---|---|---|---|---|---|---|---|---|
| Sample No. | Type of Steel | Condition Total rolling ratio (%) | Rolling ratio (%) | Final pass roller roughness (μm) | Final pass rolling ratio (%) | Final pass rolling speed (m/min.) | Finish annealing | Roller dia. (mm) | Dull roller roughness (μm) | One pass elongation ratio (%) | No. of passes | Total elongation ratio (%) |
| aA | a | 88.9 | 75.0 | 0.03 | 15 | 200 | BA | 760 | 1.4 | 0.30 | 3 | 0.90 |
| aB | | 66.7 | 50.0 | 0.03 | 15 | 200 | BA | 760 | 1.4 | 0.30 | 3 | 0.90 |
| aC | | 72.2 | 23.1 | 0.03 | 15 | 200 | BA | 760 | 1.4 | 0.30 | 3 | 0.90 |
| bA | b | 72.2 | 44.4 | 0.30 | 20 | 200 | BA | 760 | 1.8 | 0.40 | 2 | 0.80 |
| bB | | 72.2 | 44.4 | 0.50 | 20 | 200 | BA | 760 | 1.8 | 0.30 | 2 | 0.60 |
| bC | | 72.2 | 44.4 | 0.30 | 20 | 300 | BA | 760 | 1.8 | 0.40 | 2 | 0.80 |
| cA | c | 93.3 | 70.0 | 0.30 | 15 | 100 | BA | 760 | 1.8 | 0.30 | 1 | 0.30 |
| cB | | 93.3 | 70.0 | 0.30 | 20 | 100 | BA | 760 | 3.3 | 0.33 | 3 | 0.99 |
| cC | | 88.9 | 50.0 | 0.30 | 30 | 100 | BA | 760 | 1.8 | 0.34 | 4 | 1.36 |
| cD | | 88.9 | 50.0 | 0.30 | 10 | 200 | BA | 760 | 1.8 | 0.30 | 3 | 0.90 |
| cE | | 88.9 | 50.0 | 0.30 | 25 | 200 | AP (Mixed Acid) | 760 | 1.8 | 0.30 | 3 | 0.90 |
| dA | d | 86.1 | 72.2 | 0.10 | 15 | 200 | BA | 760 | 1.8 | 0.30 | 2 | 0.60 |
| dB | | 86.1 | 72.2 | 0.10 | 15 | 200 | BA | 450 | 1.8 | 0.30 | 2 | 0.60 |
| dC | | 86.1 | 72.2 | 0.10 | 15 | 200 | BA | 760 | 0.8 | 0.30 | 2 | 0.60 |
| dD | | 86.1 | 72.2 | 0.10 | 15 | 100 | BA | 760 | 3.9 | 0.30 | 2 | 0.60 |
| eA | e | 88.9 | 75.0 | 0.01 | 25 | 100 | BA | 760 | 1.8 | 0.30 | 1 | 0.30 |
| eB | | 88.9 | 75.0 | 0.03 | 25 | 100 | BA | 760 | 1.8 | 0.10 | 1 | 0.10 |
| eC | | 88.9 | 75.0 | 0.03 | 20 | 200 | BA | 760 | 1.8 | 0.65 | 1 | 0.65 |
| fA | f | 86.1 | 72.2 | 0.10 | 20 | 200 | BA | 760 | 2.0 | 0.23 | 3 | 0.70 |

TABLE 3-continued

| | | | | | | | | | | | | |
|---|---|---|---|---|---|---|---|---|---|---|---|---|
| fB | | 86.1 | 72.2 | 0.10 | 20 | 200 | BA | 760 | 2.0 | 0.05 | 2 | 0.10 |
| fC | | 86.1 | 72.2 | 0.10 | 20 | 200 | BA | 760 | 2.0 | 0.50 | 3 | 1.50 |
| gA | g | 86.1 | 72.2 | 0.03 | 15 | 200 | BA | 760 | 1.8 | 0.30 | 3 | 0.90 |
| gB | | 86.1 | 72.2 | 0.03 | 15 | 200 | AP (Mixed acid) | 760 | 1.8 | 0.30 | 3 | 0.90 |
| gC | | 86.1 | 72.2 | 0.03 | 15 | 200 | BA | 760 | 1.8 | 0.60 | 3 | 1.80 |
| hA | h | 86.1 | 72.2 | 0.03 | 15 | 200 | BA | 760 | 1.8 | 0.30 | 3 | 0.90 |
| hB | | 86.1 | 72.2 | 0.03 | 15 | 200 | AP (Electrolytic) | 760 | 1.8 | 0.30 | 3 | 0.90 |
| hC | | 86.1 | 72.2 | 0.03 | 15 | 200 | BA | 760 | 3.8 | 0.30 | 3 | 0.90 |

| Sample No. | Final plate thickness (mm) | Transfer ratio (%) | Ra (μm) | Glossiness | Micropit Quantity (No./0.01 mm$^2$) | Micropit Opening area ratio (%) | Surface adhering particle count (No./cm$^2$) | Classification |
|---|---|---|---|---|---|---|---|---|
| aA | 0.5 | 43 | 0.68 | 51 | 6 | 0.50 | 700 | Present example |
| aB | 1.5 | 45 | 0.75 | 54 | 31 | 2.50 | 3000 | Comparative example |
| aC | 1.0 | 50 | 0.80 | 59 | 35 | 3.00 | 3600 | Comparative example |
| bA | 1.0 | 30 | 0.55 | 160 | 8 | 0.60 | 700 | Present example |
| bB | 1.0 | 32 | 0.45 | 170 | 19 | 2.00 | 2200 | Comparative example |
| bC | 1.0 | 28 | 0.58 | 150 | 20 | 2.30 | 2000 | Comparative example |
| cA | 0.3 | 16 | 0.22 | 380 | 4 | 0.30 | 400 | Present example |
| cB | 0.3 | 45 | 1.13 | 43 | 9 | 0.90 | 1000 | Present example |
| cC | 0.5 | 68 | 1.18 | 35 | 7 | 0.70 | 800 | Present example |
| cD | 0.5 | 43 | 0.98 | 38 | 45 | 4.30 | 4200 | Comparative example |
| cE | 0.5 | 41 | 0.85 | 40 | 33 | 3.80 | 2800 | Comparative example |
| dA | 0.5 | 35 | 0.39 | 110 | 5 | 0.30 | 500 | Present example |
| dB | 0.5 | 30 | 1.35 | 120 | 22 | 2.50 | 2200 | Comparative example |
| dC | 0.5 | 13 | 0.17 | 440 | 6 | 0.40 | 600 | Comparative example |
| dD | 0.5 | 40 | 1.46 | 90 | 38 | 4.20 | 5600 | Comparative example |
| eA | 0.5 | 17 | 0.25 | 320 | 6 | 0.20 | 700 | Present example |
| eB | 0.5 | 5 | 0.12 | 500 | 2 | 0.20 | 500 | Comparative example |
| eC | 0.5 | 30 | 0.54 | 200 | 19 | 1.80 | 2300 | Comparative example |
| fA | 0.5 | 38 | 0.78 | 58 | 6 | 0.20 | 700 | Present example |
| fB | 0.5 | 10 | 0.14 | 450 | 4 | 0.30 | 600 | Comparative example |
| fC | 0.5 | 75 | 1.55 | 30 | 18 | 1.60 | 2300 | Comparative example |
| gA | 0.5 | 45 | 0.75 | 55 | 6 | 0.20 | 700 | Present example |
| gB | 0.5 | 48 | 0.68 | 42 | 30 | 3.20 | 3500 | Comparative example |
| gC | 0.5 | 77 | 1.08 | 34 | 22 | 2.60 | 2500 | Comparative example |
| hA | 0.5 | 35 | 0.39 | 43 | 6 | 0.20 | 700 | Present example |
| hB | 0.5 | 35 | 0.39 | 44 | 28 | 3.00 | 3200 | Comparative example |
| hC | 0.5 | 47 | 1.50 | 33 | 48 | 4.60 | 5000 | Comparative example |

TABLE 4

| Sample No. | Type of Steel | Cold Rolling Condition Total rolling ratio (%) | Finish Cold Rolling Condition: Rolling ratio (%) | Final pass roller roughness (μm) | Final pass rolling ratio (%) | Final pass rolling speed (m/min.) | Finish annealing | Dull roller temper rolling conditions: Roller dia. (mm) | Dull roller roughness (μm) | One pass elongation ratio (%) | No. of passes | Total elongation ratio (%) |
|---|---|---|---|---|---|---|---|---|---|---|---|---|
| Non-electrolytic Ni plating | | — | — | — | — | — | — | — | — | — | — | — |
| iA | i | 88.9 | 75.0 | 0.04 | 15 | 200 | BA | 760 | 1.5 | 0.30 | 3 | 0.90 |
| iB | | 66.7 | 50.0 | 0.04 | 15 | 200 | BA | 760 | 1.5 | 0.30 | 3 | 0.90 |
| iC | | 72.2 | 23.1 | 0.04 | 15 | 200 | BA | 760 | 1.5 | 0.30 | 3 | 0.90 |
| jA | j | 72.2 | 44.4 | 0.30 | 20 | 200 | BA | 760 | 1.8 | 0.40 | 2 | 0.80 |
| jB | | 72.2 | 44.4 | 0.50 | 20 | 200 | BA | 760 | 1.8 | 0.30 | 2 | 0.60 |
| jC | | 72.2 | 44.4 | 0.30 | 20 | 300 | BA | 760 | 1.8 | 0.40 | 2 | 0.80 |
| kA | k | 93.3 | 70.0 | 0.30 | 15 | 100 | BA | 760 | 1.7 | 0.30 | 1 | 0.30 |
| kB | | 93.3 | 70.0 | 0.30 | 20 | 100 | BA | 760 | 3.3 | 0.33 | 3 | 0.99 |
| kC | | 88.9 | 50.0 | 0.30 | 30 | 100 | BA | 760 | 1.7 | 0.34 | 4 | 1.36 |
| kD | | 88.9 | 50.0 | 0.30 | 10 | 200 | BA | 760 | 1.7 | 0.30 | 3 | 0.90 |
| kE | | 88.9 | 50.0 | 0.30 | 25 | 200 | AP (Mixed Acid) | 760 | 1.7 | 0.30 | 3 | 0.90 |
| lA | l | 86.1 | 72.2 | 0.03 | 20 | 200 | BA | 760 | 1.8 | 0.30 | 2 | 0.60 |
| lB | | 86.1 | 72.2 | 0.03 | 20 | 200 | BA | 450 | 1.8 | 0.30 | 2 | 0.60 |
| lC | | 86.1 | 72.2 | 0.03 | 20 | 200 | BA | 760 | 3.9 | 0.30 | 2 | 0.60 |
| mA | m | 88.9 | 75.0 | 0.01 | 25 | 100 | BA | 760 | 1.8 | 0.30 | 1 | 0.30 |
| mB | | 88.9 | 75.0 | 0.04 | 25 | 100 | BA | 760 | 1.8 | 0.10 | 1 | 0.10 |
| mC | | 88.9 | 75.0 | 0.04 | 25 | 100 | BA | 760 | 1.8 | 0.65 | 1 | 0.65 |
| nA | n | 86.1 | 72.2 | 0.03 | 20 | 200 | BA | 760 | 2.0 | 0.23 | 3 | 0.70 |
| nB | | 86.1 | 72.2 | 0.03 | 20 | 200 | BA | 760 | 2.0 | 0.05 | 2 | 0.10 |
| nC | | 86.1 | 72.2 | 0.03 | 20 | 200 | BA | 760 | 2.0 | 0.50 | 3 | 1.50 |

| Sample No. | Type of Steel | Final plate thickness (mm) | Transfer ratio (%) | Ra (μm) | Glossiness | Micropit: Quantity (No./0.01 $m^2$) | Micropit: Opening area ratio (%) | Surface adhering particle count (No./$cm^2$) | Classification |
|---|---|---|---|---|---|---|---|---|---|
| Non-electrolytic Ni plating | | — | — | — | — | 1 | 0.1 | 400 | — |
| iA | i | 0.5 | 42 | 0.65 | 50 | 5 | 0.18 | 600 | Present example |
| iB | | 1.5 | 45 | 0.73 | 53 | 30 | 1.50 | 2100 | Comparative example |
| iC | | 1.0 | 47 | 0.75 | 58 | 32 | 1.70 | 3000 | Comparative example |
| jA | j | 1.0 | 30 | 0.55 | 160 | 9 | 0.70 | 900 | Present example |
| jB | | 1.0 | 32 | 0.45 | 170 | 18 | 1.80 | 2000 | Comparative example |
| jC | | 1.0 | 28 | 0.58 | 150 | 15 | 1.80 | 1500 | Comparative example |
| kA | k | 0.3 | 16 | 0.22 | 380 | 3 | 0.10 | 500 | Present example |
| kB | | 0.3 | 45 | 1.13 | 43 | 6 | 0.50 | 700 | Present example |
| kC | | 0.5 | 68 | 1.18 | 35 | 9 | 0.80 | 900 | Present example |
| kD | | 0.5 | 43 | 0.98 | 38 | 40 | 3.50 | 3200 | Comparative example |
| kE | | 0.5 | 41 | 0.85 | 40 | 20 | 2.10 | 1900 | Comparative example |
| lA | l | 0.5 | 33 | 0.38 | 120 | 6 | 0.20 | 700 | Present example |
| lB | | 0.5 | 28 | 1.33 | 130 | 20 | 2.30 | 1800 | Comparative example |
| lC | | 0.5 | 39 | 1.45 | 80 | 48 | 4.20 | 5600 | Comparative example |
| mA | m | 0.5 | 17 | 0.25 | 320 | 6 | 0.20 | 700 | Present example |
| mB | | 0.5 | 5 | 0.12 | 500 | 2 | 0.20 | 500 | Comparative example |
| mC | | 0.5 | 30 | 0.54 | 200 | 19 | 1.80 | 2300 | Comparative example |

TABLE 4-continued

| | | | | | | | | | |
|---|---|---|---|---|---|---|---|---|---|
| nA | n | 0.5 | 38 | 0.78 | 58 | 6 | 0.20 | 700 | Present example |
| nB | | 0.5 | 10 | 0.14 | 450 | 4 | 0.30 | 600 | Comparative example |
| nC | | 0.5 | 75 | 1.55 | 30 | 18 | 1.60 | 2300 | Comparative example |

As shown in Table 3 and Table 4, in each of the present examples, the existing density of the micro-pits is 10.0 or less per 0.01 $m^2$, and the opening area ratio of the micro-pits is 1.0% or less. Furthermore, a stainless steel plate having an arithmetic mean roughness of 0.2 to 1.2 μm in a direction perpendicular to the rolling direction of the steel plate surface, and a transfer ratio of the dull pattern as 15 to 70% was obtained. The stainless steel plates according to each of the present examples had an equally low number of adhering particles of the sample to be washed as that of the non-electrolytic Ni-plated material shown in Table 4. In addition, the surface glossiness was also low and the anti-glare property was observed. Therefore, it can be evaluated that even when the surface of the stainless steel plate is left as is, the surface of the stainless steel plate is in a state of having excellent washability and anti-glare property that enable the application of the stainless steel plate as the material for precision components such as HDD members, for example.

INDUSTRIAL APPLICABILITY

The present invention, for example, is applicable as exterior building material, interior building material, automotive steel plate, commercial kitchen equipment, outer plate for home appliances, outer plate for kitchen equipment and kitchen accessories, and precision equipment components and electronic device components such as computer members, digital equipment members, HDD (hard disk drive) members and solar cell substrate material.

The invention claimed is:

1. A stainless steel plate for which temper rolling is performed by using a dull roller after a finish cold rolling and bright annealing, wherein an arithmetic mean roughness Ra in a direction perpendicular to a rolling direction of the steel plate surface is 0.2 to 1.2 μm;

a transfer ratio, which is an area ratio of a portion onto which a dull pattern is transferred relative to the steel plate surface, is 15 to 70%; and a micro-pit, being formed in the steel plate surface, having a depth of 0.5 μm or more, and having an opening area of 10 $\mu m^2$ or more, has an existing density in the steel plate surface of 10.0 or less per 0.01 $mm^2$, and an opening area ratio in the steel plate surface of 1.0% or less.

2. The stainless steel plate according to claim 1, wherein the stainless steel plate is a ferritic stainless steel plate containing, on the basis of percent by mass, C at 0.10% or less, Si from 0.1 to 2.0%, Cr from 10 to 32%, and at least either one of Nb from 0.01 to 0.8% or Ti from 0.01 to 0.5%, with residue being Fe and unavoidable impurities.

3. The stainless steel plate according to claim 2, wherein the stainless steel plate contains, on the basis of percent by mass, at least either one of Mo from 0.2 to 5% or Cu from 0.1 to 3.0%.

4. The stainless steel plate according to claim 1, wherein the stainless steel plate is a ferritic stainless steel plate containing, on the basis of percent by mass, C at 0.15% or less, Si at 2% or less, Mn at 2% or less, P at 0.04% or less, S at 0.03% or less, Ni at 0.6% or less, Cr from 11 to 32%, Mo from 0 to 3%, Cu from 0 to 1%, Nb from 0 to 1%, Ti from 0 to 1%, Al from 0 to 0.12%, N at 0.025% or less, and B from 0 to 0.01%, with residue being Fe and unavoidable impurities.

5. The stainless steel plate according to claim 1, wherein the stainless steel plate is an austenitic stainless steel plate containing, on the basis of percent by mass, C at 0.15% or less, Si at 4% or less, Mn at 10% or less, P at 0.045% or less, S at 0.03% or less, Ni from 1 to 28%, Cr from 16 to 32%, Mo from 0 to 10%, Cu from 0 to 3.5%, Nb from 0 to 1%, Ti from 0 to 1%, Al from 0 to 0.1%, N at 0.3% or less, and B from 0 to 0.01%, with residue being Fe and unavoidable impurities.

6. The stainless steel plate according to claim 1, wherein the stainless steel plate is a stainless steel plate that is used for any of a hard disk drive member, a solar cell substrate material, a precision equipment member, an electronic device member, a digital equipment member, and a computer member.

* * * * *